US006015161A

United States Patent [19]

Carlson

[11] Patent Number: 6,015,161

[45] Date of Patent: Jan. 18, 2000

[54] LONGITUDINALLY ADJUSTABLE MOUNT FOR A SNOWBOARD BINDING

[76] Inventor: Stephen R. Carlson, 798 Brooktree Rd., Pacific Palisades, Calif. 90272

[21] Appl. No.: 08/901,387

[22] Filed: Jul. 28, 1997

[51] Int. Cl.[7] ..... A63C 9/10

[52] U.S. Cl. ..... 280/626

[58] Field of Search ..... 280/633, 14.2, 280/628, 618, 623, 634, 617

[56] References Cited

U.S. PATENT DOCUMENTS

| | | | |
|---|---|---|---|
| 3,531,135 | 9/1970 | Salomon | 280/633 |
| 4,403,785 | 9/1983 | Hottel | 280/14.2 |
| 4,444,414 | 4/1984 | Bauer et al. | 280/633 |
| 4,871,337 | 10/1989 | Harris | 280/633 |
| 5,028,068 | 7/1991 | Donovan | 280/618 |
| 5,584,492 | 12/1996 | Fardie | 280/14.2 |
| 5,586,779 | 12/1996 | Dawes et al. | 280/14.2 |

FOREIGN PATENT DOCUMENTS

| | | | |
|---|---|---|---|
| 2578434 | 9/1986 | France | 280/633 |
| 2627097 | 8/1989 | France | 280/14.2 |
| 2617395 | 11/1977 | Germany | 280/633 |
| 8603983 | 7/1986 | WIPO | 280/618 |

*Primary Examiner*—Kevin Hurley
*Assistant Examiner*—Michael Britton
*Attorney, Agent, or Firm*—W. Edward Johansen

[57] ABSTRACT

An adjustable mount for use with a snowboard and a snowboard binding. The snowboard has a center-line and a channel which longitudinally extends along the center-line of the snowboard. The snowboard binding includes a binding base plate and a disc. The disc has a center-line and a bottom surface and is rotatably coupled to the binding base plate. The adjustable mount includes a rail, a bar and a locking mechanism. The rail is disposed in the channel and is fixedly coupled thereto. The rail has at least one series of notches. The binding base plate is disposed on the snowboard. The disc has a center-line and a bottom surface. The bar is disposed about the center-line of the disc and fixedly coupled thereto. The bar has at least one peripheral edge which has a series of notches which engages the series of notches of the rail. The disc is rotatably coupled to the binding base plate. The locking mechanism securely couples the rail to the bar.

3 Claims, 6 Drawing Sheets

LONGITUDINALLY ADJUSTABLE MOUNT FOR A SNOWBOARD BINDING

BACKGROUND OF THE INVENTION

The field of the invention is adjustable mounts for snowboard bindings.

Snowboarding is a sport wherein a person uses a snowboard for recreational travel down a snow-covered inclined surface. A mount fastens a binding to the snowboard. The popularity of snowboarding is growing all over the world. Snowboarding is beginning to rival skiing as a recreational sport. While snowboarding a person stands on the snowboard with both feet and his body angled to the longitudinal axis of the snowboard.

U.S. Pat. No. 5,261,698 teaches a binding whose rotational position relative to an axis perpendicular to a snowboard can be adjusted. The binding includes a hold-down plate and a binding base plate. The hold-down plate may be secured to the snowboard in several different positions on the board and is fixed to the snowboard by screws extending through a set of holes in the hold-down plate. The binding base plate can be rotated relative to the hold-down plate. The binding base plate and the hold-down plate each have ribs or ridges, respectively, which lock the angular position of the binding base plate relative to the hold-down plate. The rotational position of the binding base plate can only be adjusted by removing the boot from the binding base plate and disengaging the screws from the holes in the hold-down plate. Therefore, angular adjustment of the binding cannot be done "on the fly".

Some bindings permit a person using a snowboard to adjust their rotational orientation on the snowboard. The French company Look makes a binding which includes a circular plate and a footbed. The circular plate is attached to the snowboard by a set of screws which engage with the snowboard. The footbed has a central aperture for rotatably receiving the circular plate. A lock assembly locks the footbed in a predetermined rotational position with respect to the circular plate. A housing, including one or more fasteners, is attached to the footbed for securing a boot to the footbed so that the boot cannot be pulled free of the footbed except when the fasteners are released. A person adjusts the orientation of the binding at the beginning of the season and often makes no further adjustments.

U.S. Pat. No. 5,577,755 teaches a rotatable binding for a snowboard includes a base plate and a binding plate. The base plate is mounted on the snowboard. The binding plate is rotatably mounted on the base plate. The rotatable binding also includes a locking assembly which includes a pin and a foot binding. The locking assembly selectively locks, at a desired angle of rotation, the binding plate to the base plate. The base plate includes an indexing platform and a pedestal which is disposed on the bottom of the base plate. The indexing platform has a multiplicity of bores arranged in a circular arc about a central axis. The pedestal has a width about the width of a human foot and traverses the snowboard in order to support the indexing platform above the top surface of the snowboard. The pin does not restrict rotation of the binding base plate relative to the base plate and is selectively moveable from a raised position to a lowered position. The pin engages an indexing bore such that the binding plate may not rotate relative to the base plate.

U.S. Pat. No. 5,028,068 teaches a device which pivotally mounts a binding on a snowboard on the upper surface thereof. A manually operated handle allows the binding to be changed in any direction desired and thereafter with a flip of the handle locked into the selected position. The binding includes a binding base plate and a swivel plate. The binding base plate is mounted on the swivel plate.

U.S. Pat. No. 5,354,088 teaches a coupling which releasably mounts a binding to a turntable. The turntable is adjustably secured to a snowboard.

U.S. Pat. No. 4,871,337 teaches a snowboard in which the rider's feet are positionable within bindings which are formed on first and second riding plates. Each of the first and second riding plates is positionable above a channel section which is formed within a rider support surface of the riding apparatus. Each riding plate supports fasteners which are releasably engageable with retaining elements which are installed within the channel section. After loosening the fasteners from the retaining elements, each of the first and second riding plates may be repositioned angularly or longitudinally with respect to its channel section thereby permitting the snowboard to be used with a variety of stances and leg spacings.

U.S. Pat. No. 5,433,636 teaches a snowboard which has a channel extending along a portion of the length thereof. Two bindings are secured to the snowboard through the channel. Each binding may be rotated between a locked starting position in which the long axis of the binding extends parallel to the long axis of the snowboard and a locked skiing position in which the long axis of the binding extends transversely to the long axis of the snowboard. After the binding has been rotated to a selected position, the binding is secured in place by a locking mechanism. Each binding includes a resilient front strap assembly and a resilient heel support which secures one of the user's feet to the binding and permits a user to quickly and easily remove his feet from the bindings in the event of a fall.

Revelation Snowboard makes a snowboard which has two sets of two parallel tracks and two sets of four T-nuts. Each set of the four T-nuts float within one of the two sets of the two parallel tracks and mechanically couples one of two bindings to one of the two sets of the two parallel tracks. Revelation Snowboard has a trademark, FREEDOM GROOVE, and a patent pending for its snowboard.

U.S. Pat. No. 5,584,492 teaches an adjustable snowboard binding which can be rotatably controlled without the use of external tools. A boot mounting platform has a plurality of inwardly facing radial teeth along the circumference of a centralized circular cutout. A circumferential lip along the cutout is used to rotatably mount the platform via overlapping lipped quadrant segments which are mounted to the snowboard. Two radially sliding segments with teeth at their outer ends are held by the quadrant segments. A slidable band is mounted by actuating locking levers along the longitudinal length of the snowboard. The slidable band has upwardly extending posts which interface with angled slots formed in each sliding segment. In operation, the actuating levers are unlocked and the band slides forwards and backwards to effectuate radial movement of the sliding segments. This in turn effectuates locking engagement and disengagement between the radial circumferential teeth and the sliding segment teeth. The user performs this adjustment operation without removing the boot from the mounting platform and without loosening screws.

U.S. Pat. No. 5,586,779 teaches a binding which includes a mount plate which is fixedly mounted to a snowboard. The mount plate has a cavity centrally defined therein. A ring is fixedly attached to the mount plate which has a bore centrally defined therethrough. A hub mounts the binding to the snowboard. The hub is centrally disposed in the cavity and extends through the bore. The mount plate is free to rotate about the hub thereby allowing for adjustment of an angular position of the mount plate. A locking mechanism arrests and releases rotation of the mount plate thereby allowing the angular position of the mount plate to be adjusted. A user may quickly and easily adjust the angular position of binding relative to the snowboard without removing his boot from the binding.

SUMMARY OF INVENTION

The present invention is generally directed to an adjustable mount for a snowboard binding. A snowboard is of a sandwich construction and includes a polyethylene base, a first fiberglass layer, a wood core, a second fiberglass layer and a plastic top sheet. The snowboard has a center-line. The snowboard binding includes a binding base plate and a disc. The binding base plate is disposed on the snowboard. The disc has a center-line and a bottom surface. The disc is rotatably coupled to the binding base plate.

In a first separate aspect of the present invention, the snowboard has a channel which longitudinally extends along the center-line in the wood core, the second fiberglass layer and the plastic top sheet thereof. The mount includes a rail which is disposed in the channel and is fixedly coupled thereto. The rail has two opposing and parallel series of notches. A bar is disposed about the center-line of the disc and is fixedly coupled thereto. The bar has two peripheral edges each of which has an opposing and parallel series of notches. Each series of notches engages one of the series of notches of the rail. The locking mechanism securely couples the rail to the disc.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE PREFERRED EMBODIMENT

Figure 1:
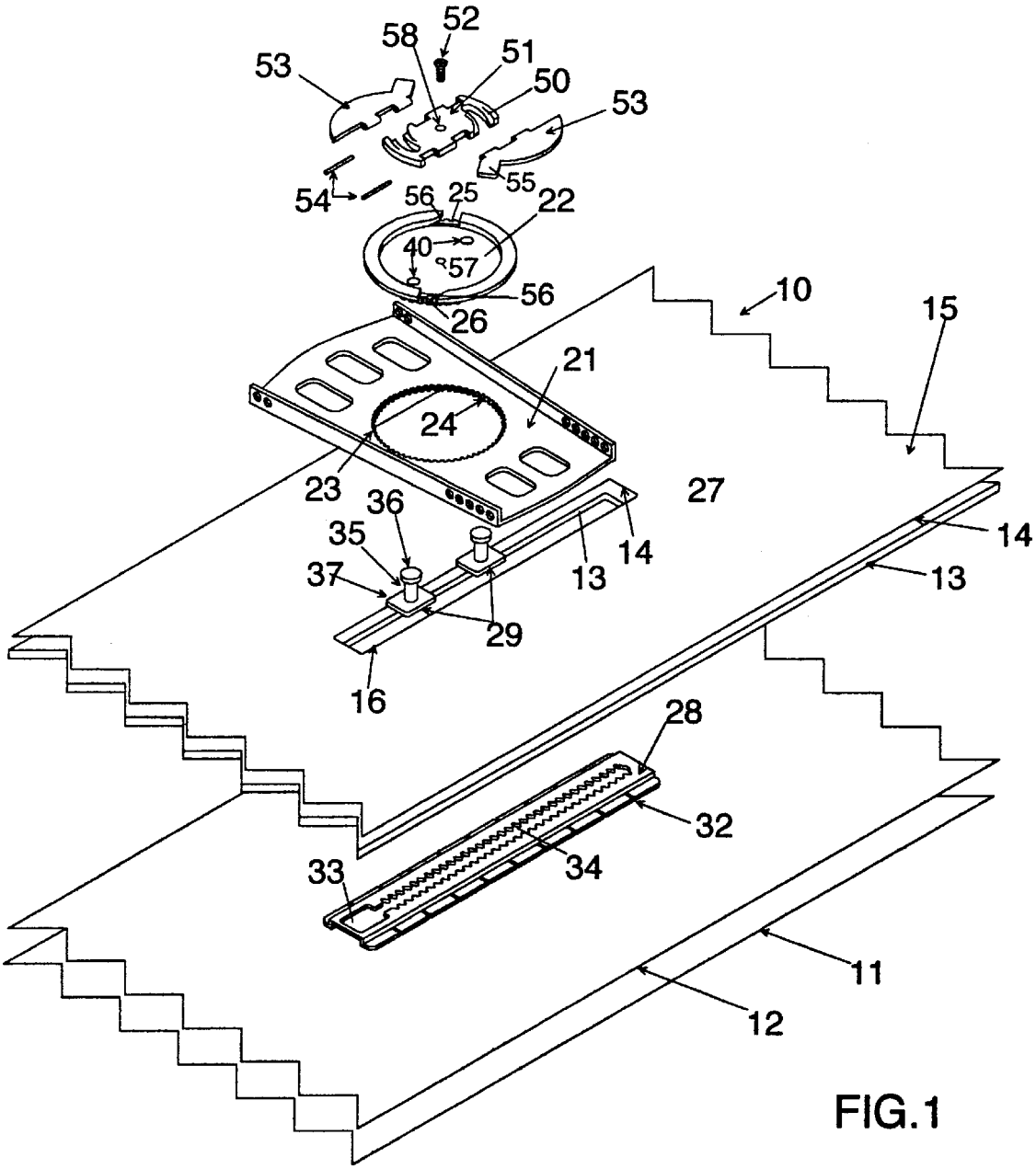
FIG. 1 is an exploded perspective drawing of a snowboard, a snowboard binding including a binding base plate and a disc and an adjustable mount including a rail and a locking mechanism including a lock plate and two handles each of which has a safety tab according to a first embodiment of the present invention.

Referring to FIG. 1 a snowboard 10 is of a sandwich construction and includes a polyethylene base 11, a first fiberglass layer 12, a wood core 13, a second fiberglass layer 14 and a plastic top sheet 15. The snowboard 10 has a center-line. A channel 16 longitudinally extends along the center-line in the wood core 13, the second fiberglass layer 14 and the plastic top sheet 15. A snowboard binding 20 includes a binding base plate 21 and a disc 22. The binding base plate 21 has a bore 23 with a plurality of inwardly directed, radially disposed teeth 24. The disc 22 has a circular peripheral side edge 25 with a plurality of outwardly directed, radially disposed teeth 26. The disc 22 is lifted away from the binding base plate 21 so that the binding base plate 21 can be rotatably adjusted. Once the binding base plate 21 has been rotatably adjusted the disc 22 is placed on the binding base plate 21 so that each of the outwardly directed, radially disposed teeth 26 of the disc 22 engages one of the inwardly directed, radially disposed teeth 24 of the binding base plate 21 in order to rotatably lock the binding base plate 21 in place relative to the disc 22. A mount 27 includes a rail 28 and two mounting pins 29.

Figure 2:
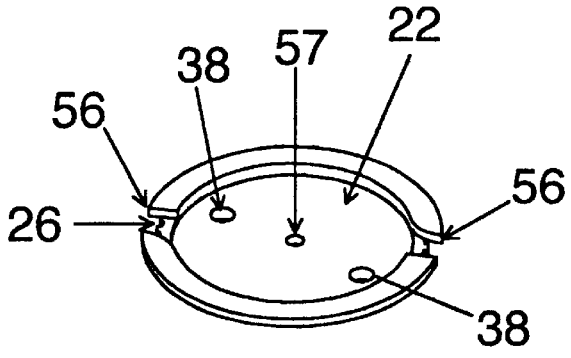
FIG. 2 is a perspective drawing of the disc of FIG. 1.
Figure 3:
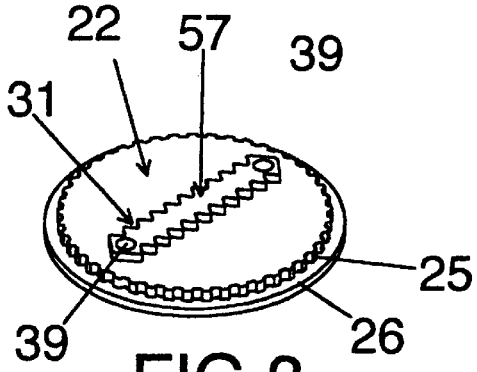
FIG. 3 is a perspective drawing of the disc of FIG. 1 after the disc has been turned over.

Referring to FIG. 1 in conjunction with FIG. 2 and FIG. 3 the disc 22 has a center-line and a bottom surface. A bar 30 is disposed on the bottom surface of the disc 22 about the center-line thereof and is fixedly coupled thereto. The bar 30 has two peripheral edges each of which has two opposing and parallel series of notches 31.

Figure 4:
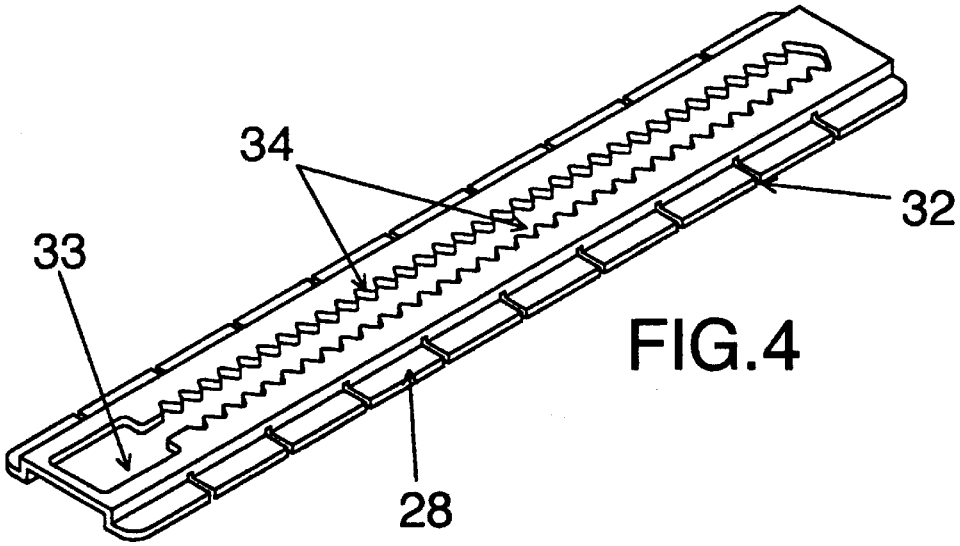
FIG. 4 is a perspective drawing of the rail of FIG. 1.

Referring to FIG. 1 in conjunction with FIG. 4 the rail 28 is a flexible member and has two sets of pluralities of slots 32 each of which extends along its side edges, a key slot 33 of a rectangular dimension and two opposing and parallel series of notches 34. The rail 28 is disposed in the channel 16 and is fixedly coupled thereto. Each mounting pin 29 includes a cylindrical shaft 35, a flat, disc-shaped cap 36 and a rectangular base 37. The flat, rectangular base 37 is of a rectangular dimension slightly smaller than the rectangular dimension of the key slot 33. The disc 22 has two bores 38 which are disposed on the center-line thereof. The bar 30 has two bores 39 each of which is aligned with one of the bores 38 of the disc 22 to form two sets of bores 40. The flat, disc-shaped cap 36 is fixedly coupled to the cylindrical shaft 35 at one end thereof. When the cylindrical shaft 35 of each mounting pin 29 has been inserted into one of the two sets of bores 40, the flat, rectangular base 37 is fixedly coupled to the cylindrical shaft 35 at the other end thereof in order to loosely secure the cylindrical shaft 35 of each mounting pin 29 within one of the two sets of bores 40. Each mounting pin 29 is slidably coupled to the rail 28 when its flat, rectangular base 37 is inserted into the key slot 33.

Figure 5:
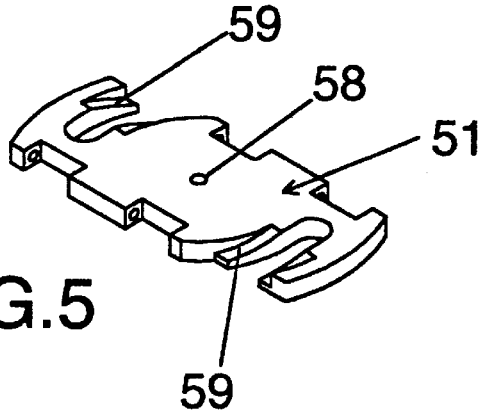
FIG. 5 is a perspective drawing of the lock plate of FIG. 1.

Referring to FIG. 1 in conjunction with FIG. 5 a locking mechanism 50 includes a lock plate 51, a screw 52 of a diameter, two handles 53, two pins 54. Each handle 53 has a safety tab 55. The disc 22 has two safety slots 56. Each pin 54 rotatably couples the one of the handles 53 to the lock plate 51. Each safety tab 55 is disengageably coupled to one of the safety slots 56. The disc 22 has a threaded bore 57 which is axially disposed. The lock plate 51 has a bore 58 which is axially disposed and which is of a diameter slightly larger than the diameter of the screw 52. The screw 52 is inserted into the bore 58 of the lock plate 51 and is then threaded into the threaded bore 57 of the disc 22 thereby rotatably coupling the lock plate 51 to the disc 22. The lock plate 51 has two curved ramps 59 which are oppositely disposed. The cylindrical shaft 35 of each mounting pin 29 is slidably coupled to one of the curved ramps 59. The flat, disc-shaped cap 36 of each mounting pin 29 secures it therein.

Figure 6:
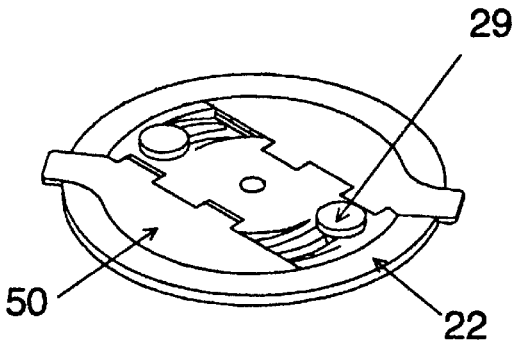
FIG. 6 is a schematic drawing of the locking mechanism of FIG. 1 when locked with the safety tabs engaged.

Referring to FIG. 1 in conjunction with FIG. 6 when the locking mechanism 50 is locked and each safety tab 55 engages one of the safety slots 56. Each series of notches 34 of the rail 28 engages one of the series of notches 31 of the bar 30 so that the snowboard binding 20 can not be adjusted longitudinally relative to the snowboard 10.

Figure 7:
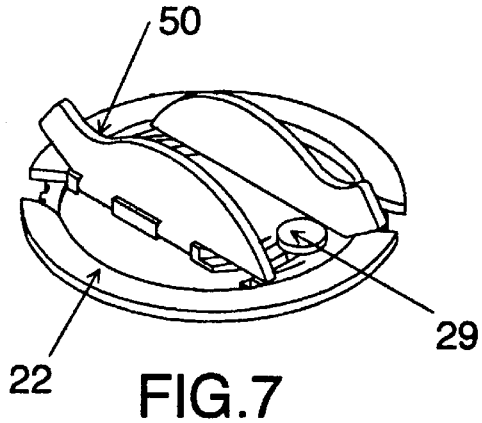
FIG. 7 is a schematic drawing of the locking mechanism of FIG. 1 when locked with the safety tabs disengaged.
Figure 8:
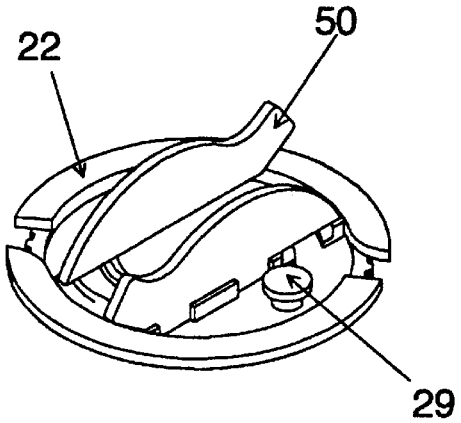
FIG. 8 is a schematic drawing of the locking mechanism of FIG. 1 when unlocked.

Referring to FIG. 1 in conjunction with FIG. 7 and FIG. 8 when the locking mechanism 50 is locked and each safety tab 55 has disengaged itself from one of the safety slots 56. A snowboarder may use the handles 53 to rotate the lock plate 51 in order to unlock it and release the disc 22 from the binding base plate 21 and the rail 28.

Figure 9:
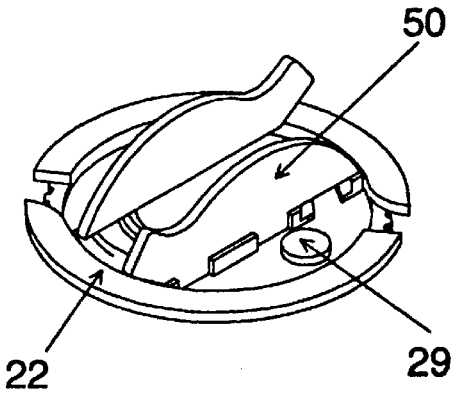
FIG. 9 is a schematic drawing of the locking mechanism of FIG. 1 when unlocked and released.

Referring to FIG. 1 in conjunction with FIG. 9 and FIG. 8 when the locking mechanism 50 is unlocked and released. By lifting the disc 22 from the rail each series of notches 34 of the rail 28 is disengaged from one of the series of notches 31 of the bar 30 so that the snowboard binding 20 can be adjusted longitudinally relative to the snowboard 10.

Figure 10:
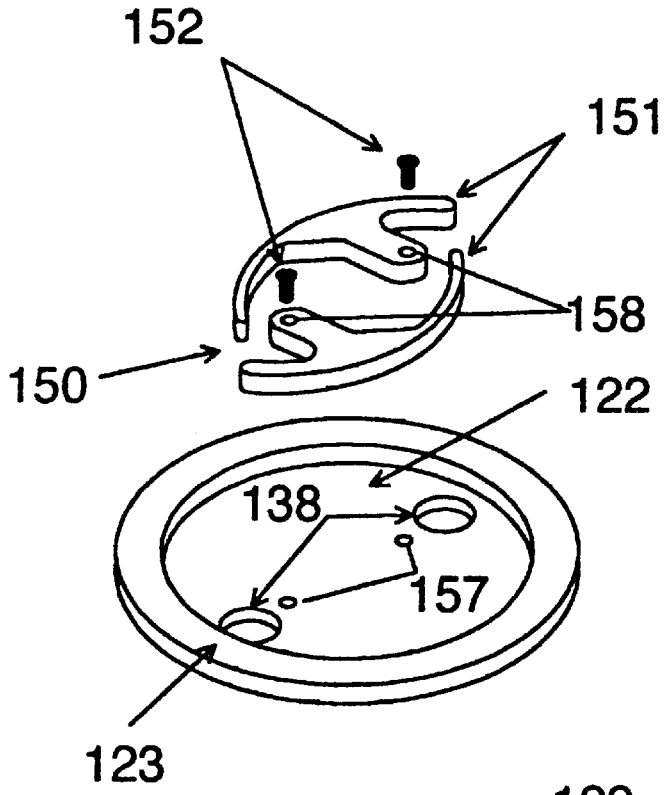
FIG. 10 is an exploded perspective drawing of a disc of a snowboard binding and two locking levers of a locking mechanism according to a second embodiment of the present invention.
Figure 11:
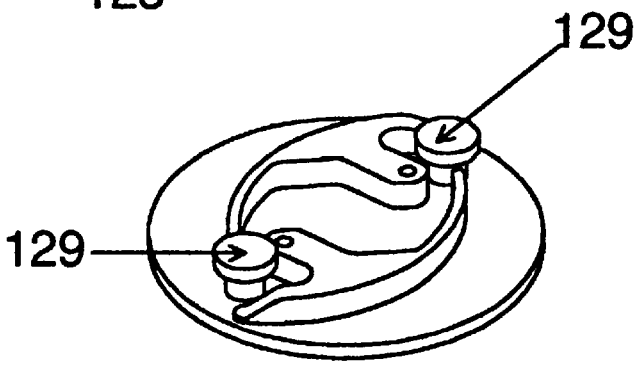
FIG. 11 is a schematic drawing of the locking mechanism of FIG. 10 when locked.
Figure 12:
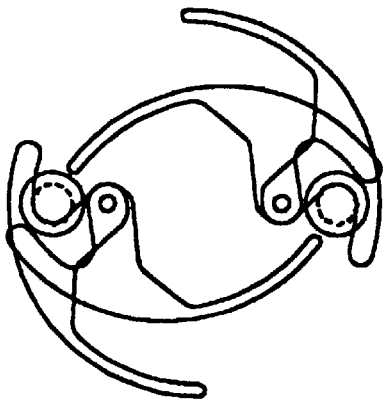
FIG. 12 is a schematic drawing of the locking mechanism of FIG. 10 when unlocked and released.

Referring to FIG. 10 in conjunction with FIG. 11 and FIG. 12 a snowboard binding includes a binding base plate and a disc 122. The disc 122 has a circular peripheral side edge 123 with a plurality of outwardly directed, radially disposed teeth. The disc 122 is lifted away from the binding base plate so that the binding base plate can be rotatably adjusted. Once the binding base plate has been rotatably adjusted the disc is placed on the binding base plate so that all of the outwardly directed, radially disposed teeth of the disc 122 engage all of the inwardly directed, radially disposed teeth of the binding base plate in order to rotatably lock the binding base plate in place relative to the disc 122. A mount includes two mounting pins 129. The disc 122 has a center-line and a bottom surface. The disc 122 has two bores 138 which are disposed on the center-line thereof. A locking mechanism 150 includes two locking levers 151 and two screws 152 of a diameter. The disc 122 has two threaded bores 157 each of which is disposed adjacent to one of the two bores thereof. Each locking lever 151 has a bore 158 which is of a diameter slightly larger than the diameter of each screw 152. Each screw 152 is inserted into the bore 158 of one of the locking levers 151 and is then threaded into the threaded bore 157 of the disc 122 thereby rotatably coupling each of the locking levers 151 to the disc 122. Each locking lever 151 engages the cylindrical shaft of one of mounting pins 129 in order to lock the disc 122 in place. Each locking lever 151 disengages itself from the cylindrical shaft of one of mounting pins 129 in order to unlock the disc 122 in place so that the snowboard binding can be adjusted longitudinally relative to the snowboard.

Figure 13:
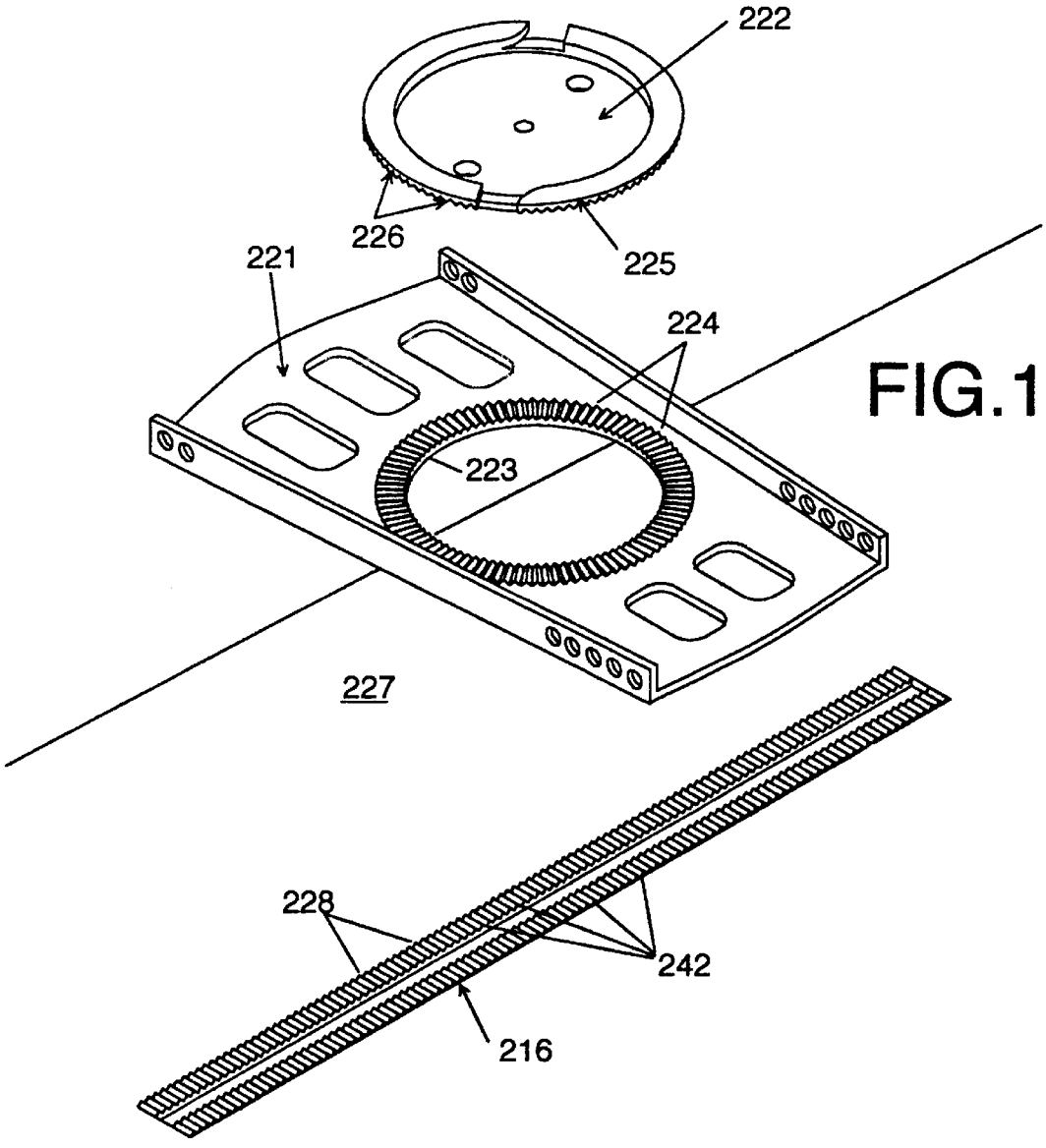
FIG. 13 is a partial, exploded perspective drawing of a snowboard, a snowboard binding including a binding base plate and a disc and an adjustable mount including a rail according to a third embodiment of the present invention.
Figure 14:
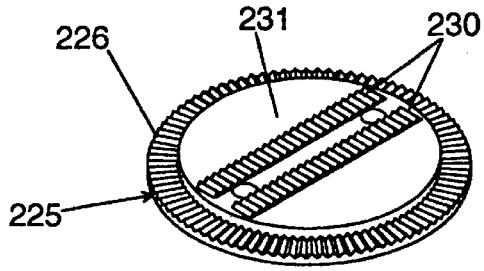
FIG. 14 is a perspective drawing of the disc of FIG. 13 after the disc has been turned over.

Referring to FIG. 13 in conjunction with FIG. 14 a snowboard 210 has a channel 216. A snowboard binding 220 includes a binding base plate 221 and a disc 222. The binding base plate 221 has a bore 223 with a plurality of upwardly directed, radially disposed teeth 224. The disc 222 has a circular peripheral side edge 225 with a plurality of downwardly directed, radially disposed teeth 226. The disc 222 is lifted away from the binding base plate 221 so that the binding base plate 221 can be rotatably adjusted. Once the binding base plate 221 has been rotatably adjusted the disc 222 is placed on the binding base plate 221 so that all of the downwardly directed, radially disposed teeth 226 of the disc 222 engage all of the upwardly directed, radially disposed teeth 224 of the binding base plate 221 in order to rotatably lock the binding base plate 221 in place relative to the disc 222. A mount 227 includes two rails 228 and two mounting pins.

Still referring to FIG. 13 in conjunction with FIG. 14 the disc 222 has a center-line and a bottom surface. Two bars 230 are oppositely and parallelly disposed on the bottom surface of the disc 222 about the center-line thereof and are fixedly coupled thereto. Each bar 230 has a series of downwardly directed notches 231. The rails 228 are disposed in the channel 216 and is fixedly coupled thereto. Each rail 228 has a series of upwardly directed notches 242.

Figure 15:
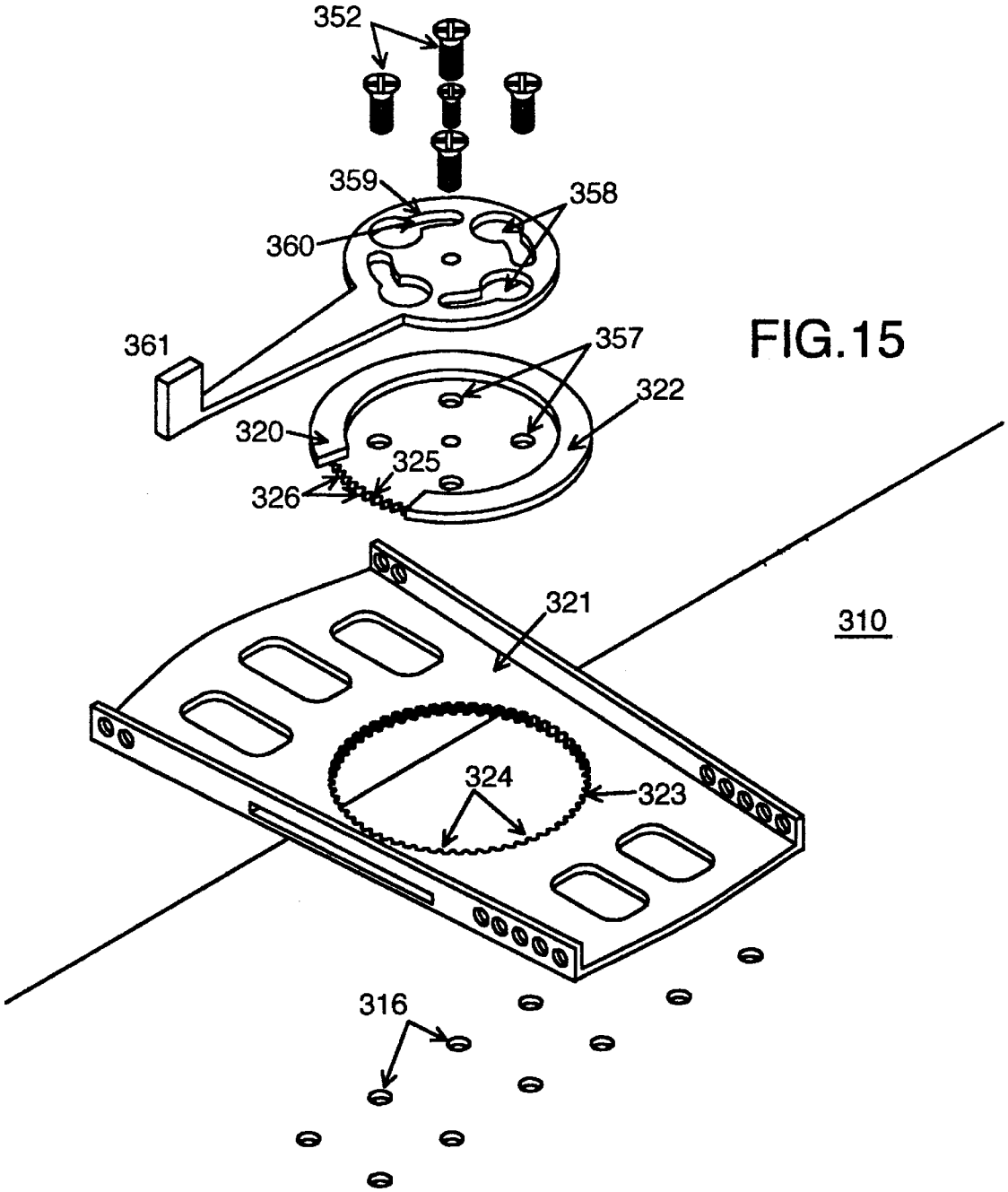
FIG. 15 is an exploded perspective drawing of a snowboard and a snowboard binding including a binding base plate, a disc and a lock plate according to a fourth embodiment of the present invention.

Referring to FIG. 15 a snowboard 310 is of a sandwich construction and includes a polyethylene base, a first fiberglass layer, a wood core, a second fiberglass layer and a plastic top sheet 315. The snowboard 310 has a center-line. Two parallel and opposing series of threaded bores 316 longitudinally extend about the center-line in the snowboard 310. A snowboard binding 320 includes a binding base plate 321 and a disc 322. The binding base plate 321 has a bore 323 with a plurality of inwardly directed, radially disposed teeth 324. The disc 322 has a circular peripheral side edge 325 with a plurality of outwardly directed, radially disposed teeth 326. The disc 322 is lifted away from the binding base plate 321 so that the binding base plate 321 can be rotatably adjusted. Once the binding base plate 321 has been rotatably adjusted the disc 322 is placed on the binding base plate 321 so that each of the outwardly directed, radially disposed teeth 326 of the disc 322 engages one of the inwardly directed, radially disposed teeth 324 of the binding base plate 321 in order to rotatably lock the binding base plate 321 in place relative to the disc 322.

Still referring to FIG. 15 a locking mechanism 350 includes a lock plate 351, four screws 352. The disc 322 has a center axis and four bores 357 each of which is disposed about the center axis thereof. The lock plate 351 has a center axis and four bores 358 each of which is disposed about the center axis thereof. Each bore 358 of the lock plate 351 is of a diameter slightly larger than the diameter of one of the screws 352. Each screw 352 is inserted into one of the four bores 358 of the lock plate 351 and is then threaded into one of the four threaded bores 357 of the disc 322 thereby coupling the lock plate 351 to the disc 322. The lock plate 351 has four curved slots 359 which are disposed about the center axis thereof. Each curved slot 359 has within it a curved ramp 360. Each curved slot 359 is disposed adjacent and contiguous to one of the four bores 358 of the lock plate 351. The lock plate 351 has a handle 361. A snowboarder may use the handle 361 to rotate the lock plate 351 in order to unlock it and release the disc 322 from the binding base plate 320. The snowboard binding of U.S. Pat. No. 5,261,698 includes a hold-down plate and a binding base plate. The hold-down plate is fixed to the snowboard by four screws extending through a set of four holes in the hold-down plate. The binding base plate can be rotated relative to the hold-down plate. The binding base plate and the hold-down plate each have ribs or ridges, respectively, which lock the angular position of the binding base plate relative to the hold-down plate. The rotational position of the binding base plate can only be adjusted by removing the boot from the binding base plate and disengaging the screws from the holes in the hold-down plate. The disc 322 and the lock plate 351 may replace the hold-down plate. Similarly two snowboard bindings 320 each of which includes the binding base plate 321, the disc 322 and the lock plate 351 may be used with the snowboard which Revelation Snowboard makes. The snowboard has two sets of two parallel tracks and two sets of four T-nuts. Each set of the four T-nuts float within one of the two sets of the two parallel tracks and mechanically couples one of two snowboard bindings 320 to one of the two sets of the two parallel tracks. Revelation Snowboard has a trademark, FREEDOM GROOVE, and a patent pending for its snowboard.

From the foregoing it can be seen that a longitudinally adjustable mount for a snowboard binding has been described. It should be noted that the sketches are not drawn to scale and that distance of and between the figures are not to be considered significant.

Accordingly it is intended that the foregoing disclosure and showing made in the drawing shall be considered only as an illustration of the principle of the present invention.

What is claimed is:

1. A combination snowboard, binding and mount comprising:

a. a snowboard having a center-line wherein said snowboard has a channel longitudinally extending along said center-line;

b. a rail disposed in said channel and fixedly coupled thereto wherein said rail has at least one series of notches;

c. a binding base plate disposed on said snowboard;

d. a disc having a center-line and a bottom surface on which a bar is disposed about said center-line thereof and fixedly coupled thereto with said bar having at least one peripheral edge which has a series of notches which engages said series of notches of said rail, said disc being rotatably coupled to said binding base plate; and e. a locking mechanism securely coupling said rail to said disc.

2. A combination of an adjustable mount, a snowboard binding and a snowboard wherein the snowboard has a center-line and a channel which longitudinally extends along the center-line and wherein the snowboard binding includes a binding base plate and a disc which has a center-line and a bottom surface and which is rotatably coupled to the binding base plate, said adjustable mount comprising:

a. a rail disposed in the channel and fixedly coupled thereto wherein said rail has at least one series of notches; and b. a bar is disposed on the disc about its center-line thereof and fixedly coupled thereto with said bar having at least one peripheral edge which has a series of notches which engages said series of notches of said rail; and e. a locking mechanism securely coupling said rail to said bar.

3. A combination of an adjustable mount, a snowboard binding and a snowboard wherein the snowboard has a center-line and a channel which longitudinally extends along the center-line and wherein the snowboard binding includes a binding base plate and a disc which has a bottom surface and which is rotatably coupled to the binding base plate, said adjustable mount comprising:

a. a rail disposed in the channel and fixedly coupled thereto wherein said rail has at least one series of upwardly directed notches; and b. at least one bar is disposed on the disc thereof and fixedly coupled thereto with said bar having a series of downwardly directed notches which engages said series of upwardly directed notches of said rail; and e. a locking mechanism securely coupling said rail to said bar.

* * * * *